US012605611B2

(12) United States Patent
Bova

(10) Patent No.: US 12,605,611 B2
(45) **Date of Patent: *Apr. 21, 2026**

(54) APPARATUS AND METHODOLOGY FOR PRESERVING A YOGA MAT

(71) Applicant: Kimberly Lin Bova, Scotch Plains, NY (US)

(72) Inventor: Kimberly Lin Bova, Scotch Plains, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/752,534

(22) Filed: Jun. 24, 2024

(65) Prior Publication Data

US 2024/0342575 A1 Oct. 17, 2024

Related U.S. Application Data

(63) Continuation of application No. 17/956,371, filed on Sep. 29, 2022, now Pat. No. 12,017,127, which is a (Continued)

(51) Int. Cl.
*A63B 71/00* (2006.01)
*A45C 13/30* (2006.01)

(Continued)

(52) U.S. Cl.
CPC ..... *A63B 71/0036* (2013.01); *A45C 13/30* (2013.01); *A45F 3/14* (2013.01);

(Continued)

(58) Field of Classification Search
CPC ..... A63B 21/4037; A63B 2209/00; A63B 71/0036; A63B 2210/50;

(Continued)

(56) References Cited

U.S. PATENT DOCUMENTS

2005/0192158 A1 9/2005 Edwards
2007/0110950 A1 * 5/2007 Yang ..... B32B 27/32 428/95

(Continued)

FOREIGN PATENT DOCUMENTS

JP 2012236406 A * 12/2012 ..... A63B 21/4037
TW 1404517 B 12/2010

(Continued)

OTHER PUBLICATIONS

"Delicate", Definition, Collin's Dictionary, www.collinsdictionary.com/dictionary/english/delicate.*

(Continued)

*Primary Examiner* — Madison Emanski

(57) ABSTRACT

Aspects of the disclosure relate to yoga mats. In one example, a yoga mat preserver is disclosed, which includes a perimeter with dimensions substantially similar to a yoga mat, and a thickness substantially less than a thickness of the yoga mat. For this example, at least one component of the yoga mat preserver comprises a moisture absorbent material. In another example, a yoga mat carrier is disclosed, which includes a first end configured to wrap around a circumference of a first end of a rolled yoga mat, and a second end configured to wrap around a circumference of a second end of the rolled yoga mat. The yoga mat carrier further includes a strap in which a first end is attached to the first end of the yoga mat carrier, and a second end is attached to the second end of the yoga mat carrier.

7 Claims, 16 Drawing Sheets

Related U.S. Application Data continuation of application No. 16/182,550, filed on Nov. 6, 2018, now Pat. No. 11,471,742.

(60) Provisional application No. 62/582,230, filed on Nov. 6, 2017.

(51) Int. Cl.
*A45F 3/14* (2006.01)
*A63B 21/00* (2006.01)

(52) U.S. Cl.
CPC .... *A63B 21/4037* (2015.10); *A45F 2003/142* (2013.01); *A63B 2209/00* (2013.01); *A63B 2210/50* (2013.01)

(58) Field of Classification Search
CPC ..... A63B 2071/0694; A63B 6/00; A63B 2209/10; A63B 2209/02; B32B 2307/744; B32B 2471/04; B32B 5/024; B32B 25/10; B32B 27/12; B32B 5/18; A47G 27/0237; A47G 9/062; H05F 3/02; H05F 3/025; A61N 1/14; Y10S 482/907; A45C 13/30; A45F 3/14; A45F 2003/142; A47K 10/02
USPC ..... 5/498, 417, 420; 482/23, 148, 142, 14, 482/140
See application file for complete search history.

(56) References Cited

U.S. PATENT DOCUMENTS

| | | | | |
|---|---|---|---|---|
| 2014/0259398 | A1 | 9/2014 | Kendall | |
| 2014/0342118 | A1* | 11/2014 | Connaughton | A63B 6/00 428/218 |
| 2016/0129300 | A1* | 5/2016 | Moore | B32B 7/05 428/35.5 |
| 2016/0332023 | A1 | 11/2016 | Taylor et al. | |
| 2017/0319896 | A1 | 11/2017 | Kramer | |
| 2018/0257832 | A1 | 9/2018 | Loeffler | |
| 2019/0126121 | A1* | 5/2019 | Ramaswamy | A63B 71/0036 |

FOREIGN PATENT DOCUMENTS

| | | | | |
|---|---|---|---|---|
| WO | 2013163669 | A1 | 11/2013 | |
| WO | WO 2016174684 | A1 * | 11/2016 | D03D 7/00 |

OTHER PUBLICATIONS

"Monolithic." Merriam-Webster, Merriam-Webster, www.merriam-webster.com/dictionary/monolithic#:~:text=3-,a,by%20often%20rigidly%20fixed%20uniformity.*

"Why is static electricity also called friction electricity?" Byju. byjus.com/question-answer/why-is-static-electricity-also-called-friction-electricity/. Office Action dated Jul. 28, 2024, Parent U.S. Appl. No. 17,956,371.

* cited by examiner

APPARATUS AND METHODOLOGY FOR PRESERVING A YOGA MAT

CROSS-REFERENCE TO RELATED APPLICATIONS

This application is a continuation application of U.S. patent application Ser. No. 17/956,371 filed Sep. 29, 2022, entitled APPARATUS AND METHODOLOGY FOR PRESERVING A YOGA MAT, which will issue as U.S. Pat. No. 12,017,127 on Jun. 25, 2024, which is a continuation of U.S. patent application Ser. No. 16/182,550, filed Nov. 6, 2018, entitled "APPARATUS AND METHODOLOGY FOR PRESERVING A YOGA MAT," now U.S. Pat. No. 11,471,742 issued Oct. 18, 2022, which claims priority to and the benefit of U.S. provisional patent application No. 62/582,230 filed on Nov. 6, 2017, wherein the entire contents of each of the above applications are incorporated herein by reference.

TECHNICAL FIELD

The subject disclosure generally relates to yoga mats, and more specifically to an apparatus and methodology for preserving yoga mats.

Introduction

By way of background concerning conventional yoga mats, it is noted that yoga enthusiasts (referred to herein as "yogis") are often stigmatized for not properly cleaning their yoga mats. Indeed, yogis often do not have the time or space to properly clean their yoga mats (e.g., with mat cleaning solution and clean towel/cleaning mop), and subsequently hang their yoga mats to thoroughly dry after practicing yoga. Instead, although several products directed towards proper yoga mat care currently exist (e.g., mat cleaning sprays, antimicrobial towels to wipe down mats, drying racks, mat cleaning machines, etc.), many yogis simply wipe down their mat with a dirty sweat towel (i.e., rather than carrying a separate clean towel and/or travel sized cleaning solution spray), and subsequently roll their damp dirty mat for travel.

Even when a yoga studio provides patrons with cleaning materials, it is noted that such items are often undesirably shared (e.g., a shared cleaning mop often accumulates sweat from other yogis). Moreover, since many yogis practice in studios, proper cleaning and hanging to dry is not practical. For instance, if a yogi is able to properly clean their mat, there is rarely adequate space (or time) to let their mat hang to dry before rolling it up into a bag for one's commute home. The bacteria from sweat inevitably grows between the tightly rolled mat that often remains tightly coiled until the next yoga practice. This is not to say that yogis never clean and dry their mats, but rather that it is a very common occurrence for this not to happen properly every time.

It should also be noted that antimicrobial/antibacterial cork mats (rare to see at yoga classes) and anti-microbial coatings to mats also exist. Mats with anti-microbial coatings are often expensive, however, and are not necessarily effective or adequately regulated by the Food and Drug Administration (FDA). For instance, it is well known that even when such mats are "properly" cleaned (i.e., immediately wiped down after use and allowed to dry), a distinctive odor often remains.

Currently, there is thus no effective solution to address the specific problem of storing and transporting improperly cleaned, sweaty mats after yoga practice. Accordingly, it would be desirable to provide an apparatus and methodology which overcomes these limitations. To this end, it should be noted that the above-described deficiencies are merely intended to provide an overview of some of the problems of conventional systems, and are not intended to be exhaustive. Other problems with the state of the art and corresponding benefits of some of the various non-limiting embodiments may become further apparent upon review of the following detailed description.

BRIEF SUMMARY OF SOME EXAMPLES

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

Various aspects directed towards yoga mats also disclosed. In one example, a yoga mat preserver is disclosed, which includes a perimeter with dimensions substantially similar to a yoga mat, and a thickness substantially less than a thickness of the yoga mat. For this example, at least one component of the yoga mat preserver comprises a moisture absorbent material.

In another example, a yoga mat carrier is disclosed. Here, a first end of the yoga mat carrier is configured to wrap around a circumference of a first end of a rolled yoga mat, whereas a second end of the yoga mat carrier is configured to wrap around a circumference of a second end of the rolled yoga mat. The yoga mat carrier further includes a strap in which a first end of the strap is attached to the first end of the yoga mat carrier, and a second end of the strap is attached to the second end of the yoga mat carrier.

These and other aspects of the invention will become more fully understood upon a review of the detailed description, which follows. Other aspects, features, and embodiments of the present invention will become apparent to those of ordinary skill in the art, upon reviewing the following description of specific, exemplary embodiments of the present invention in conjunction with the accompanying figures. While features of the present invention may be discussed relative to certain embodiments and figures below, all embodiments of the present invention can include one or more of the advantageous features discussed herein. In other words, while one or more embodiments may be discussed as having certain advantageous features, one or more of such features may also be used in accordance with the various embodiments of the invention discussed herein. In similar fashion, while exemplary embodiments may be discussed below as device, system, or method embodiments it should be understood that such exemplary embodiments can be implemented in various devices, systems, and methods.

BRIEF DESCRIPTION OF THE DRAWINGS

Various non-limiting embodiments are further described with reference to the accompanying drawings in which.

DETAILED DESCRIPTION

Overview

As discussed in the introduction, it would be desirable to address the specific problem of storing and transporting improperly cleaned, sweaty mats after yoga practice. The various embodiments disclosed herein are directed towards overcoming these limitations by providing a yoga mat preserver configured to be placed over a yoga mat. In a particular embodiment, such yoga mat preserver is an absorbent, antibacterial and/or antimicrobial, lightweight, machine washable, durable layer that may be placed on top of a yoga mat and rolled up with one's mat after practice for storage and preservation between proper washing and drying. By placing the disclosed moisture absorbent yoga mat preserver on top of an improperly cleaned yoga mat, the yoga mat preserver absorbs excess sweat and slows down bacterial growth and accompanying odor. The disclosed yoga mat preserver is thus a solution to the taboo and unspoken, yet common, issue of improperly cleaning and drying yoga mats after yoga practice. Moreover, the disclosed yoga mat preserver is directed towards preserving and protecting one's yoga mat by reducing bacterial growth and odor between proper cleanings (i.e., the disclosed yoga mat preserver is a supplement to proper care, rather than a substitute to proper care).

It should also be noted that the concept of a yoga mat preserver itself does not currently exist. Indeed, although the market is saturated with yoga mat towels/covers used over one's mat during practice (e.g., to guard against sweat falling on the yoga mat), there is currently no product configured to absorb moisture already on the mat and meant for storage to extend the hygienic life of one's mat after practice. In a particular aspect, it is thus contemplated that the yoga mat preserver disclosed herein may be noticeably lighter than conventional yoga mat towels/covers that are meant to be used during practice. It is further contemplated that by utilizing a lightweight fabric, the disclosed yoga mat preserver may be easily folded and remain somewhat compact (i.e., will not take up more room than one's hand towel or water bottle, for example).

Exemplary Yoga Mat Preserver Embodiments

Figure 1:
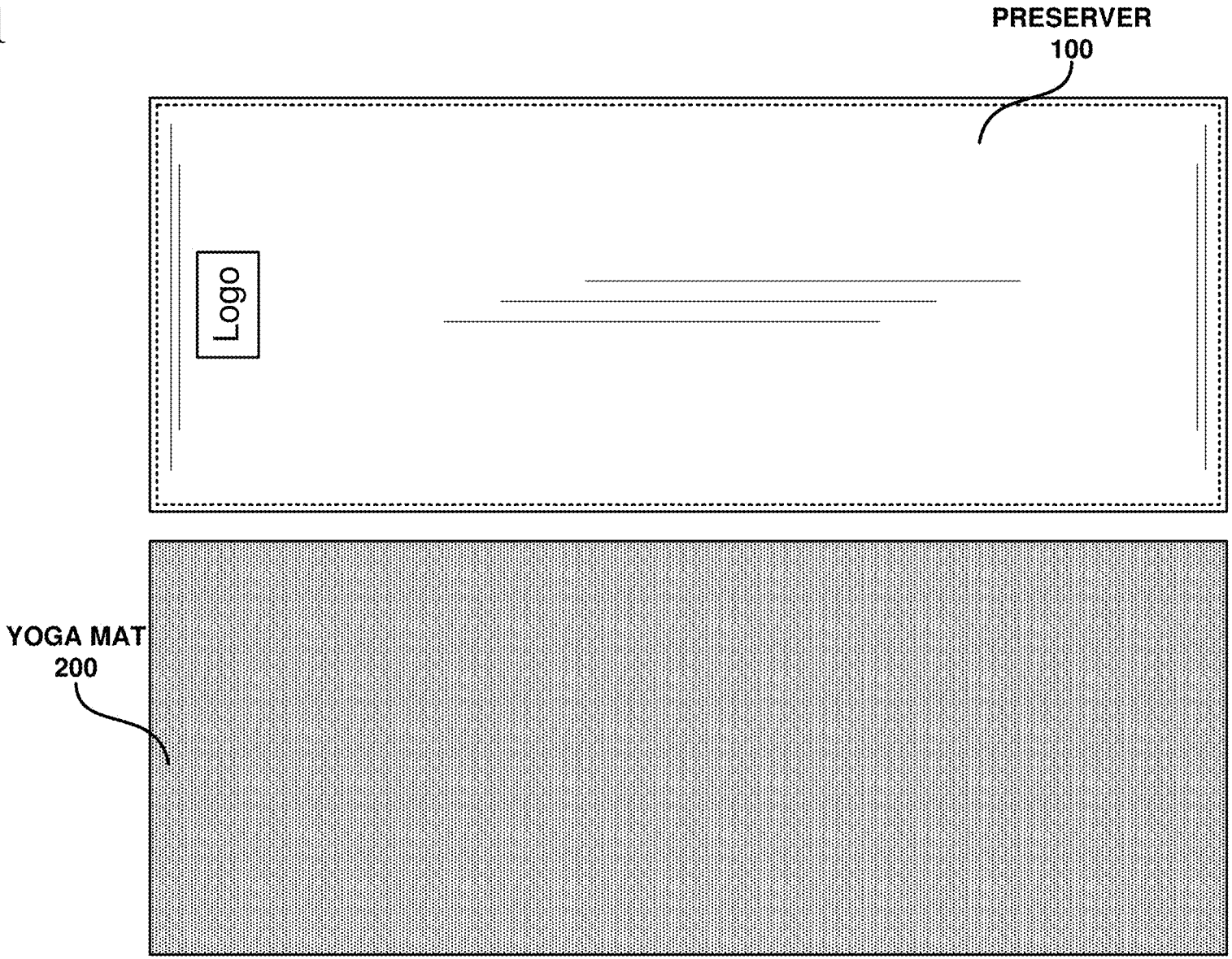
FIG. 1 illustrates a top view of a yoga mat and exemplary yoga mat preserver in accordance with an aspect of the subject specification.
Figure 2:
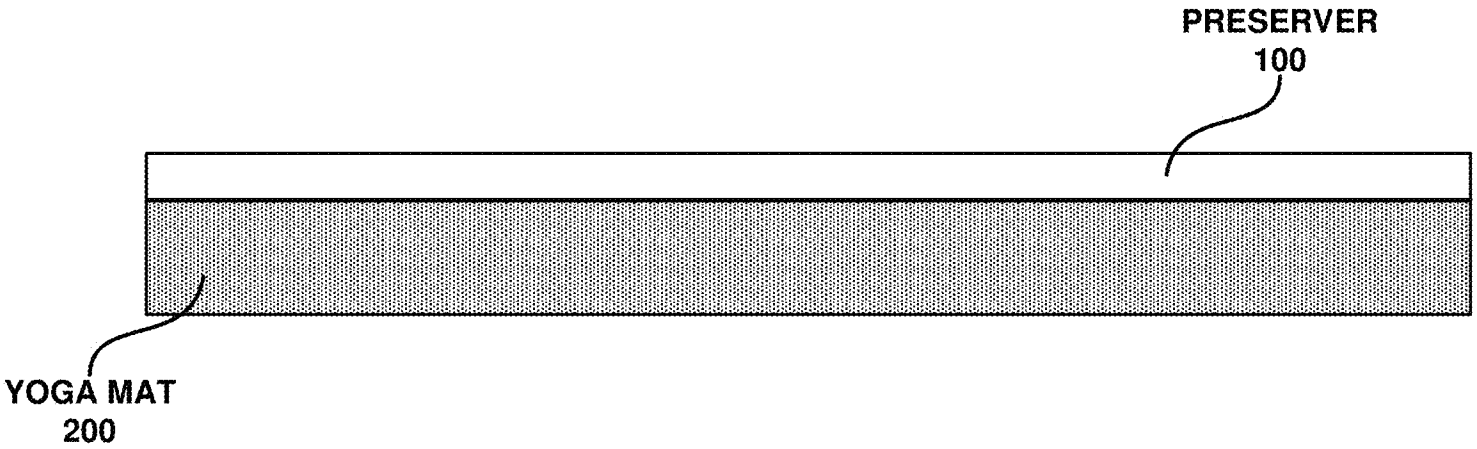
FIG. 2 illustrates a side view of a yoga mat coupled to an exemplary yoga mat preserver in accordance with an aspect of the subject specification.
Figure 3:
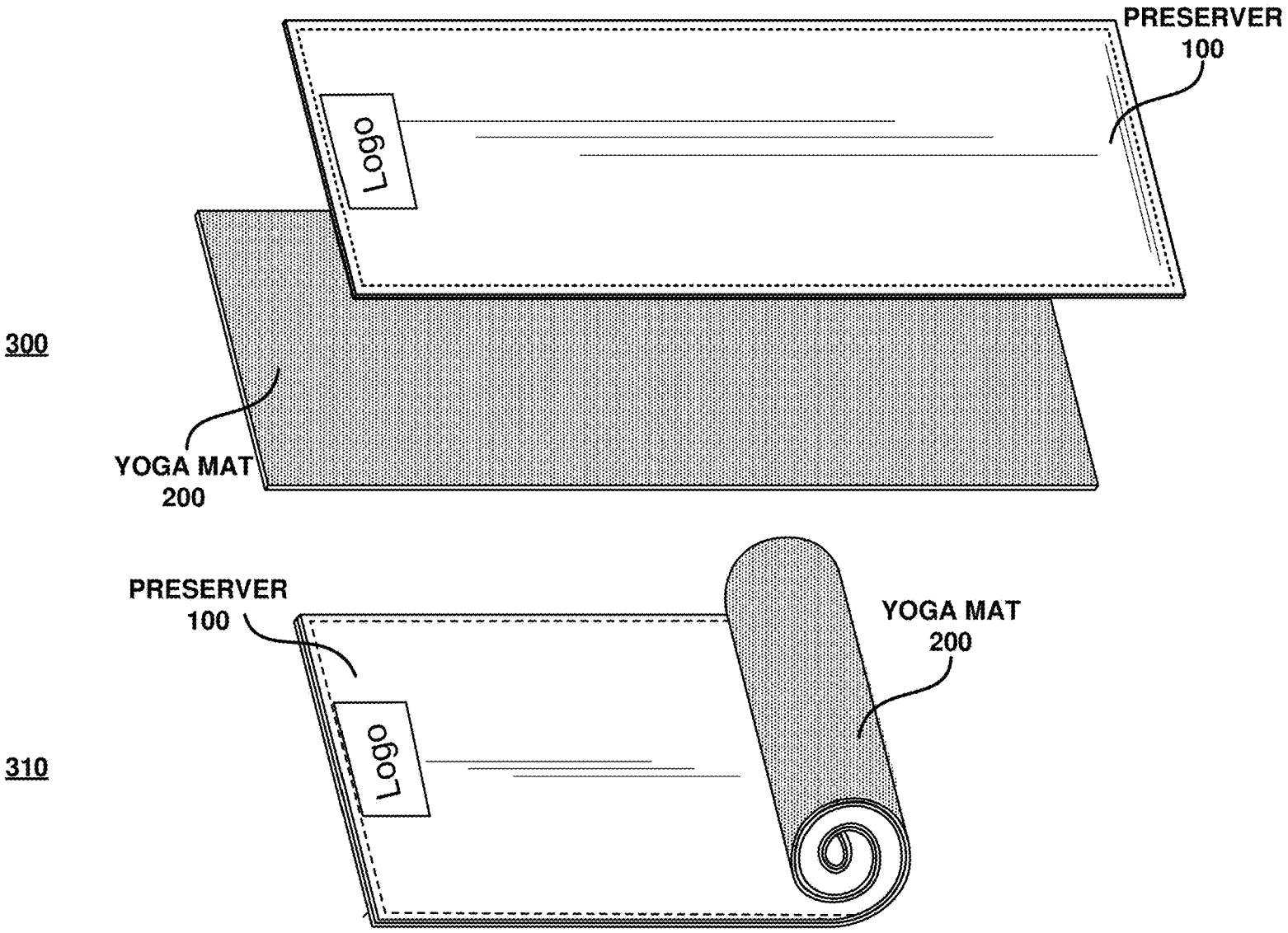
FIG. 3 illustrates a perspective view of a yoga mat coupled to an exemplary yoga mat preserver in accordance with an aspect of the subject specification.

Turning now to FIGS. 1-3, various views of a yoga mat 100 and an exemplary yoga mat preserver 200 in accordance with an aspect of the subject specification are provided. In particular, FIG. 1 illustrates a top view of yoga mat 100 and yoga mat preserver 200; FIG. 2 illustrates a side view of yoga mat 100 coupled with yoga mat preserver 200; and FIG. 3 illustrates a perspective view of yoga mat 100 coupled with yoga mat preserver 200. As illustrated, yoga mat preserver 200 comprises a perimeter with dimensions substantially similar to yoga mat 100, and a thickness substantially less than a thickness of yoga mat 100, as illustrated in FIG. 2. To this end, since it is noted that the thinnest of conventional yoga mats are approximately 1/16", it is contemplated that the thickness of yoga mat preserver 200 would be as thin as possible and substantially less than 1/16" (e.g., less than or equal to the thickness of a thin terry cloth or thin beach towel) so that it could be used for rolling storage, as illustrated in views 300 and 310 in FIG. 3 (e.g., wherein the thickness of the yoga mat preserver 200 equal to or less than 1/48"). It should also be noted that yoga mat preserver 200 may be manufactured from a particular material, and to have a particular thickness, so that yoga mat preserver 200 is foldable and/or machine washable.

In another aspect of the disclosure, it is further contemplated that at least one component of yoga mat preserver 200 comprises a moisture absorbent material (e.g., bamboo, hemp, microfiber, cotton, polyester, fleece, etc.) configured to absorb moisture, such as sweat, that may accumulate on yoga mat 100. In a particular embodiment, the moisture absorbent material is a blend of hemp, cotton, and polyester (e.g., 45% hemp, 40% organic cotton, and 15% polyester). The particular material used for yoga mat preserver 200 may also be an antibacterial and/or antimicrobial material, or include a coating of an antibacterial and/or antimicrobial substance. Moreover, in development, it should be appreciated that a number of fabrics can be used with an antimicrobial additive, wherein such "developed fabric" may be any absorbent fabric comprising anti-bacterial and/or antimicrobial technology. Furthermore, in order to more firmly attach to yoga mat 100, yoga mat preserver 200 may include material that facilitates static electricity so as to cling onto yoga mat 100.

Figure 4:
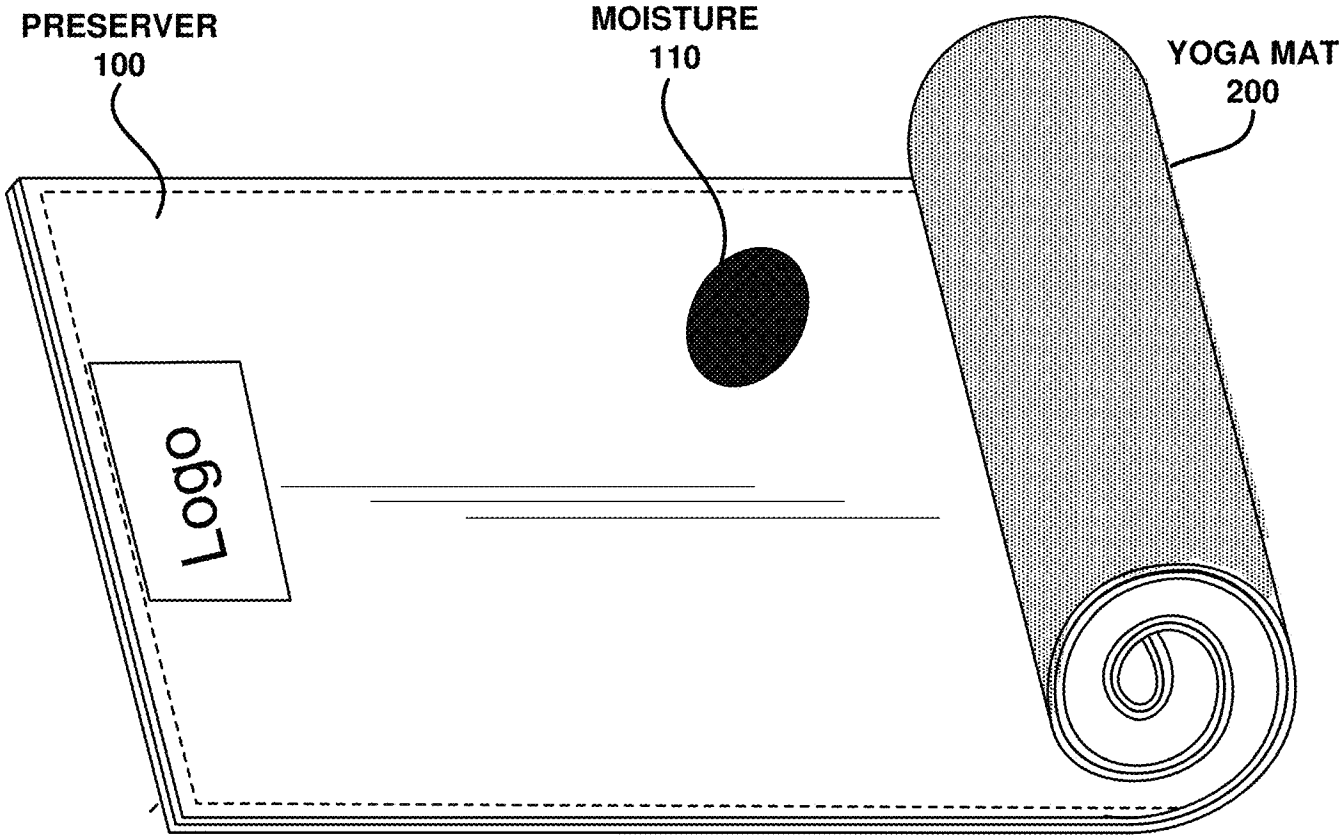
FIG. 4 illustrates an exemplary yoga mat preserver in which moisture undesirably seeps through to an opposite side.
Figure 5:
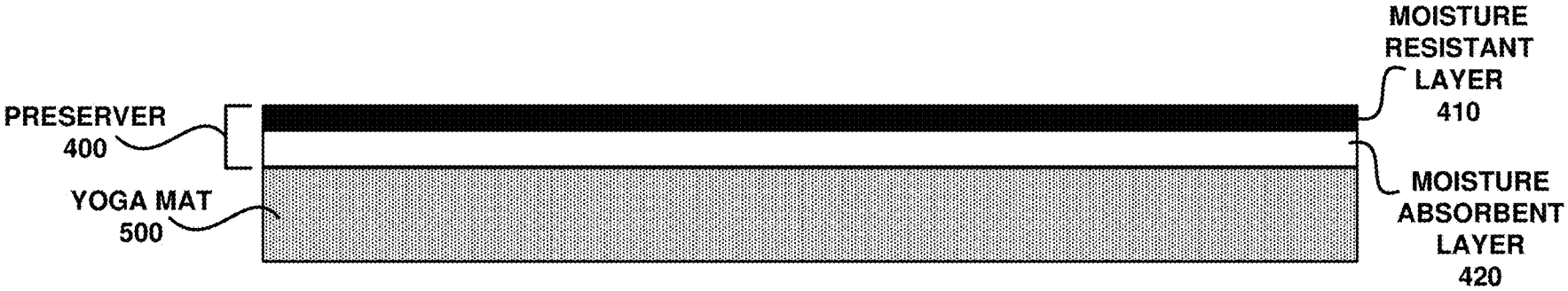
FIG. 5 illustrates a side view of an exemplary dual-layer yoga mat preserver in accordance with an aspect of the subject specification.

It should be noted that a substantial amount of moisture may occasionally remain on some portions of a yoga mat 100, which may undesirably seep through to an opposite side of yoga mat preserver 200. For example, as illustrated in FIG. 4, when such moisture 110 seeps through to an opposite side of the yoga mat preserver 200, a bottom portion of yoga mat 100 will undesirably come in contact with moisture 110 upon rolling yoga mat 100 together with yoga mat preserver 200. Accordingly, in addition to the disclosed single layer embodiments of yoga mat preserver 200, multilayer embodiments are also contemplated, including the dual-layer embodiment provided in FIG. 5, wherein a first layer of the yoga mat preserver 400 is a moisture absorbent layer 420, and wherein a second layer of the yoga mat preserver 400 is a moisture resistant layer 410 (e.g., rubber, latex, vinyl, nylon, polyurethane, etc.). Within such embodiment, moisture absorbed by yoga mat preserver 400 never seeps across moisture resistant layer 410, and thus never comes in contact with a bottom portion of yoga mat 500 when rolled together with yoga mat preserver 400.

Figure 6:
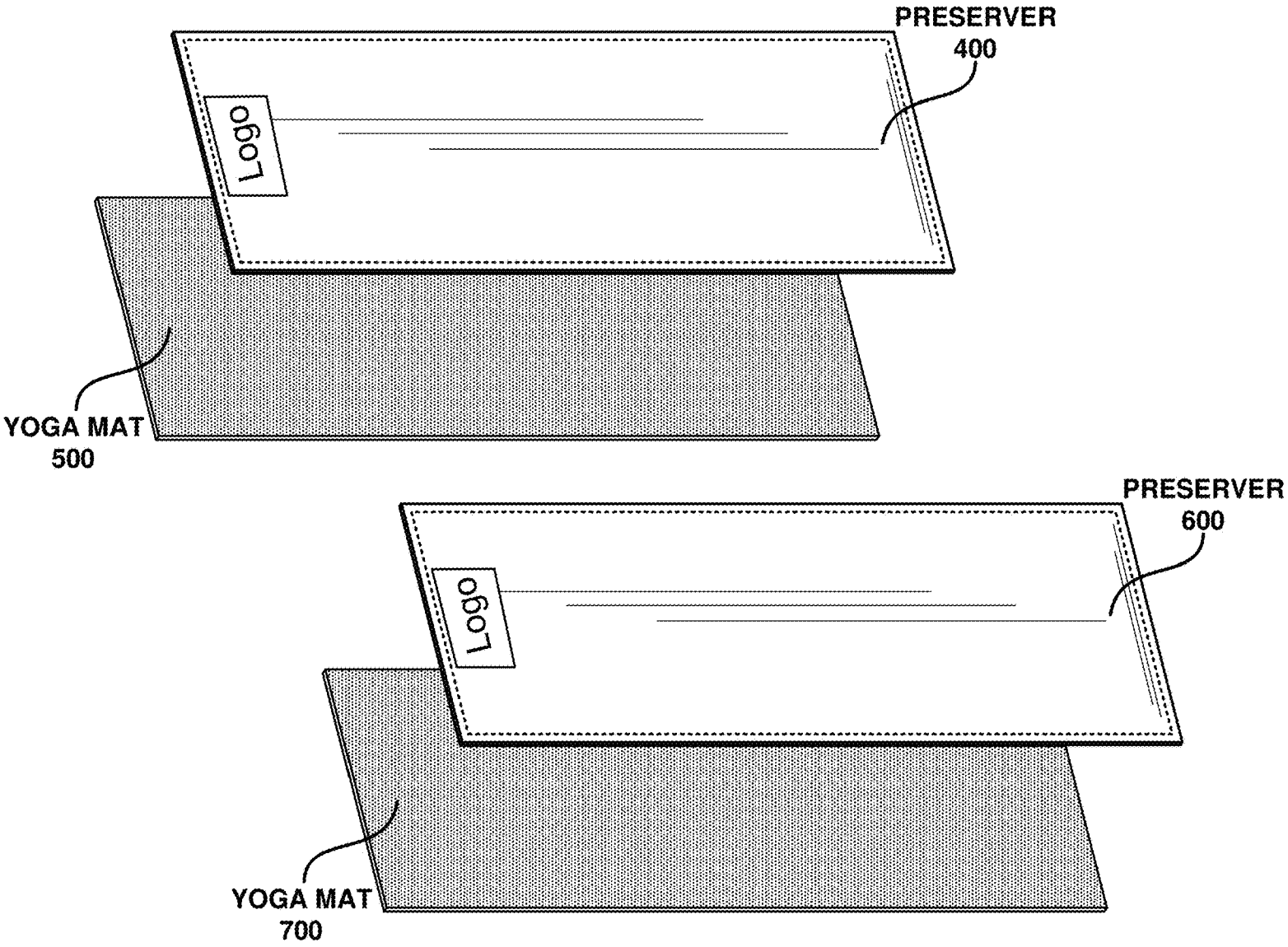
FIG. 6 illustrates a stack use scenario for an exemplary dual-layer yoga mat preserver in accordance with an aspect of the subject specification.
Figure 7:
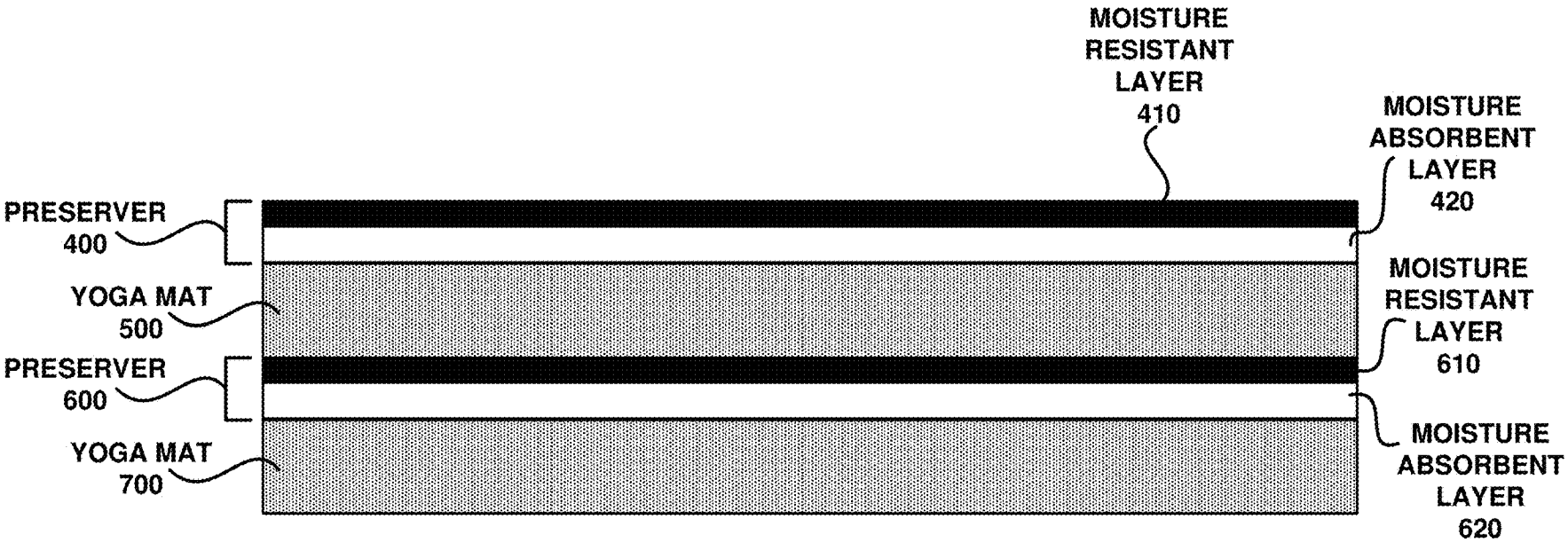
FIG. 7 illustrates a side view of the stack use scenario for the exemplary dual-layer yoga mat preserver illustrated in FIG. 6.

Since yoga mats are often stacked on top of each other for storage (e.g., at gyms or yoga studios), it is also anticipated that such multilayer designs would desirably safeguard against cross contamination in which moisture from one yoga mat is transferred to another mat. In FIGS. 6-7, for instance, a stack use scenario for the aforementioned dual-layer design is provided in accordance with an aspect of the subject specification. As illustrated, a first yoga mat preserver 400 is coupled to a first yoga mat 500, whereas a second yoga mat preserver 600 is coupled to a second yoga mat 700. Here, because it is anticipated that yoga mat 500 may be stacked onto yoga mat 700, as illustrated in FIG. 7, it is contemplated that yoga mat preserver 600 may include a moisture absorbent layer 620 configured to absorb moisture from yoga mat 700, and further include a moisture resistant layer 610 configured to prevent such moisture from making contact with yoga mat 500. Similarly, yoga mat preserver 400 may include a moisture absorbent layer 420 configured to absorb moisture from yoga mat 500, and further include a moisture resistant layer 410 configured to prevent such moisture from making contact with another yoga mat that may be stacked on top of yoga mat 500.

Figure 8:
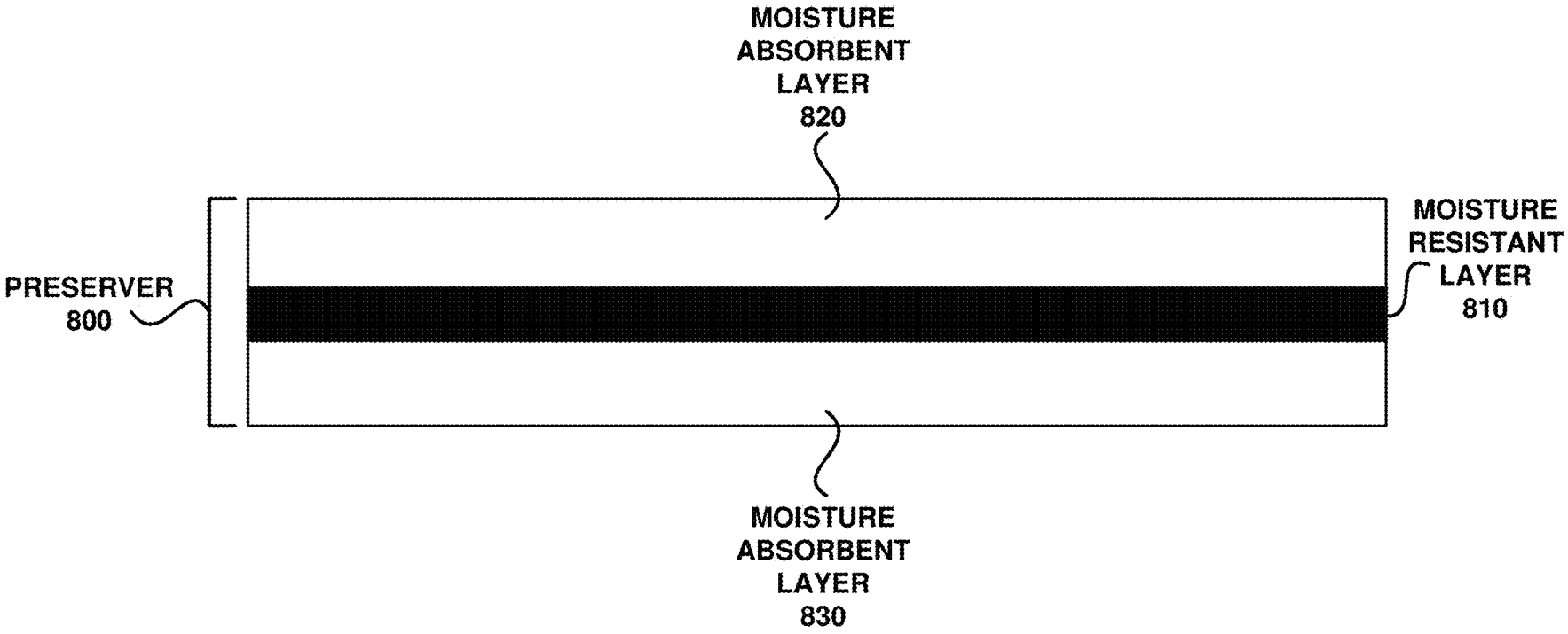
FIG. 8 illustrates a side view of an exemplary tri-layer yoga mat preserver in accordance with another aspect of the subject specification.

In another embodiment, a tri-layer yoga mat preserver design is also disclosed. For instance, as illustrated in FIG. 8, an exemplary tri-layer yoga mat preserver 800 includes a moisture resistant layer 810 in between a first moisture absorbent layer 820 and a second moisture absorbent layer 830. Here, it is anticipated that such tri-layer design may thus facilitate absorbing moisture from the top of a yoga mat covered by yoga mat preserver 800, as well as moisture from the bottom of a yoga mat stacked on top of yoga mat preserver 800, wherein moisture resistant layer 810 prevents cross contamination between the two yoga mats.

Figure 9:
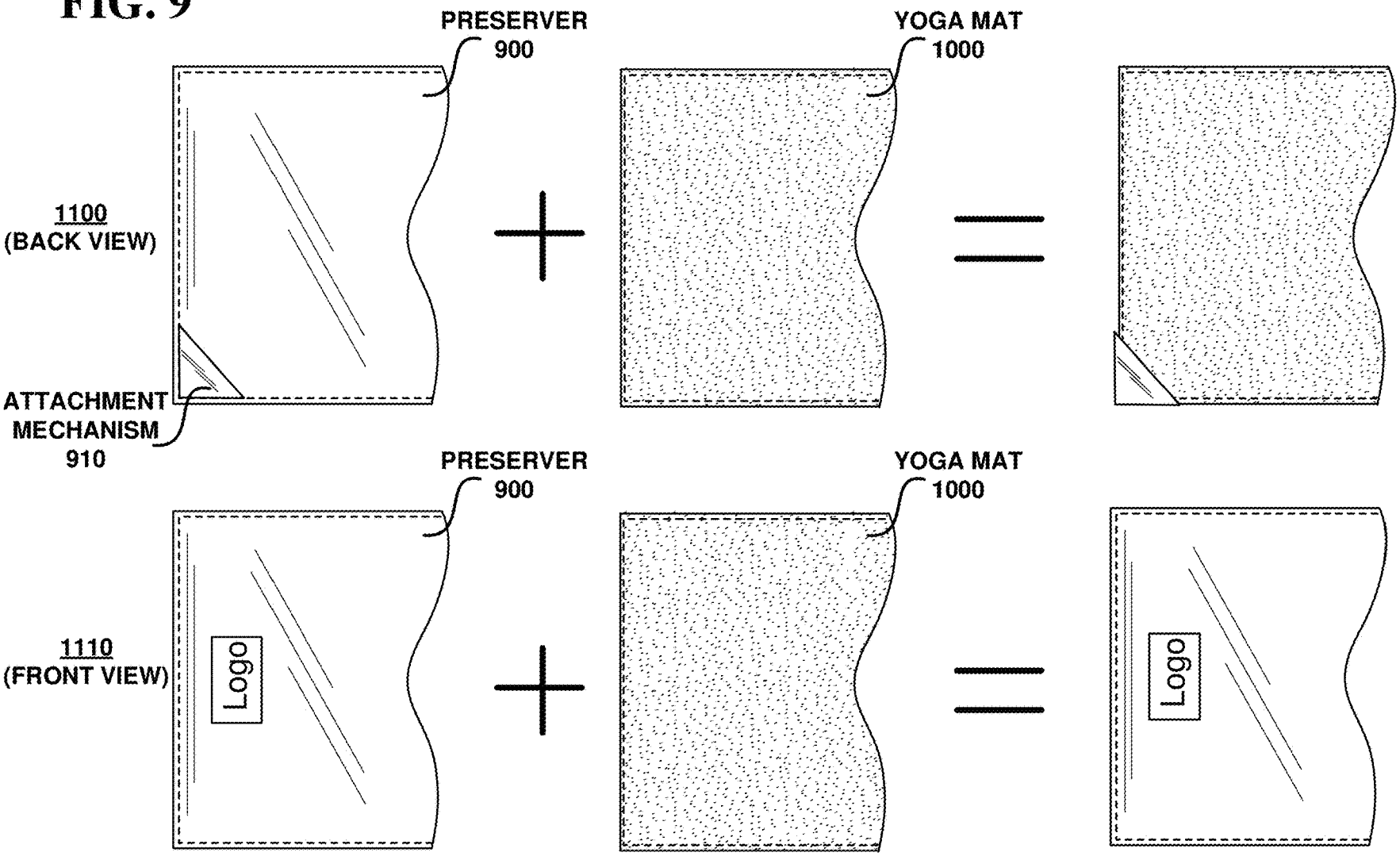
FIG. 9 illustrates a yoga mat preserver with a first attachment mechanism in accordance with an aspect of the subject specification.

Various attachment mechanisms to facilitate attaching the disclosed yoga mat preserver to a yoga mat are also contemplated. In FIG. 9, for instance, an exemplary yoga mat preserver with an attachment mechanism is provided in accordance with an aspect of the subject specification. As illustrated, a back view 1100 and a front view 1110 of an exemplary coupling of a yoga mat preserver 900 and a yoga mat 1000 are provided. For this particular embodiment, yoga mat preserver 900 includes an attachment mechanism 910 in the form of a triangular pocket on a corner of yoga mat preserver 900, wherein attachment mechanism 910 is configured to receive a corresponding corner of yoga mat 1000, as shown.

Figure 10:
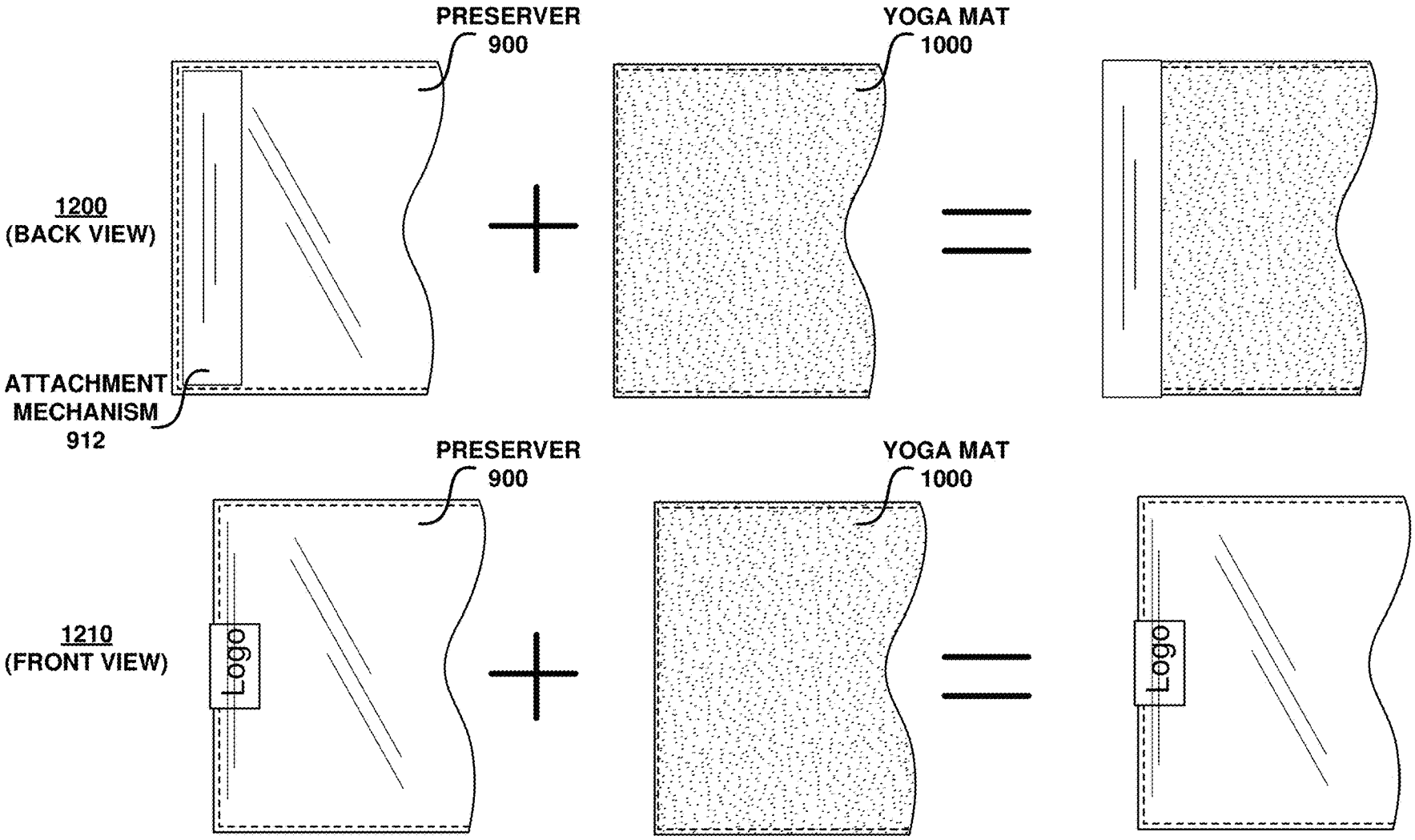
FIG. 10 illustrates a yoga mat preserver with a second attachment mechanism in accordance with an aspect of the subject specification.

Referring next to FIG. 10, yoga mat preserver 900 is illustrated with a second type of attachment mechanism 912 in accordance with an aspect of the subject specification. As illustrated, a back view 1200 and a front view 1210 of an exemplary coupling of a yoga mat preserver 900 and a yoga mat 1000 are provided. For this particular embodiment, yoga mat preserver 900 includes an attachment mechanism 912 in the form of a rectangular pocket on at least one end of yoga mat preserver 900, wherein attachment mechanism 912 is configured to receive a corresponding end of yoga mat 1000, as shown.

Figure 11:
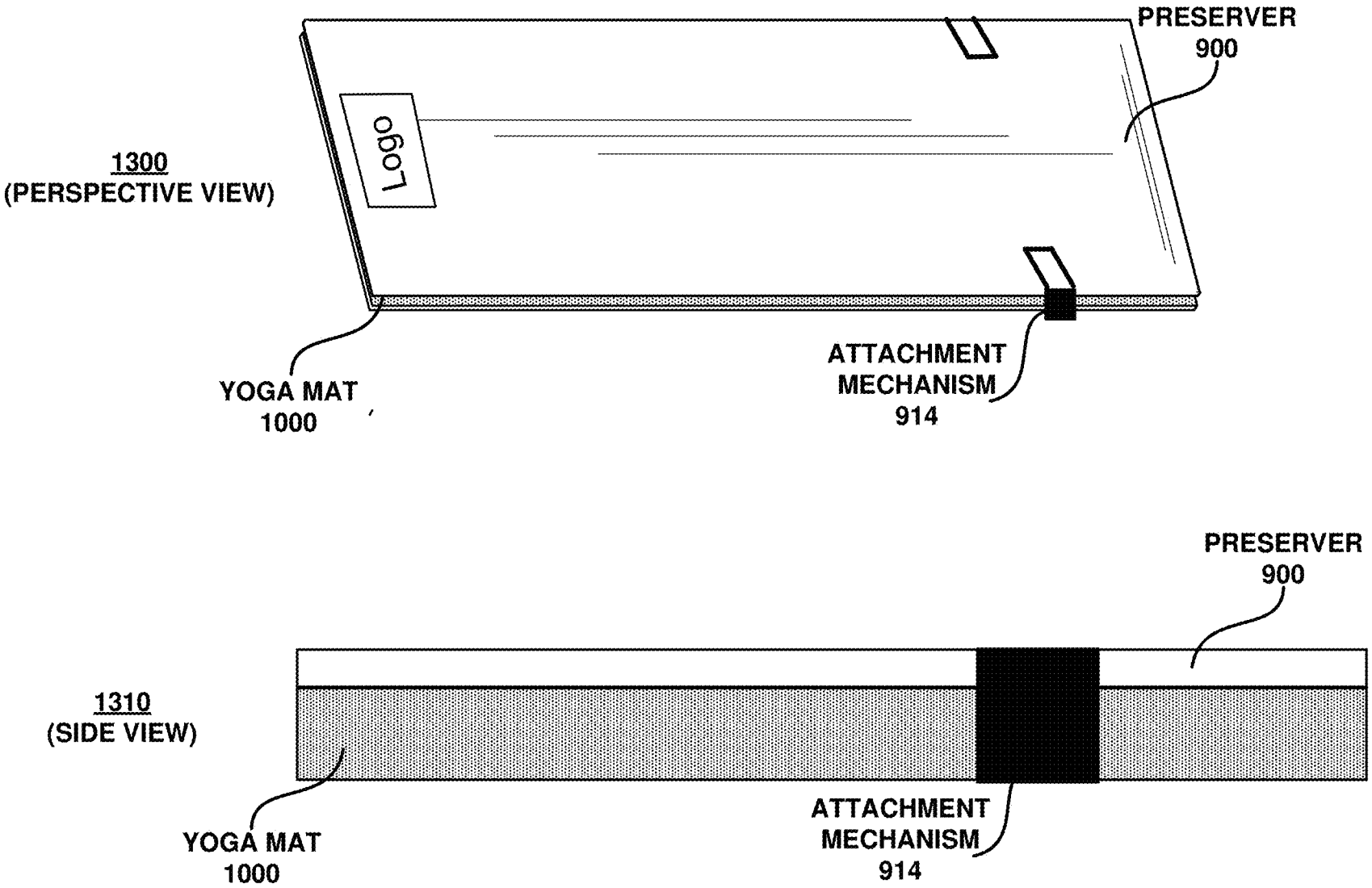
FIG. 11 illustrates a yoga mat preserver with a third attachment mechanism in accordance with an aspect of the subject specification.

Referring next to FIG. 11, yoga mat preserver 900 is illustrated with a third type of attachment mechanism 914 in accordance with an aspect of the subject specification. As illustrated, a perspective view 1300 and a side view 1310 of an exemplary coupling of a yoga mat preserver 900 and a yoga mat 1000 are provided. For this particular embodiment, yoga mat preserver 900 includes an attachment mechanism 914 in the form of at least one attachment clip coupled to the yoga mat preserver 900, as shown.

Figure 12:
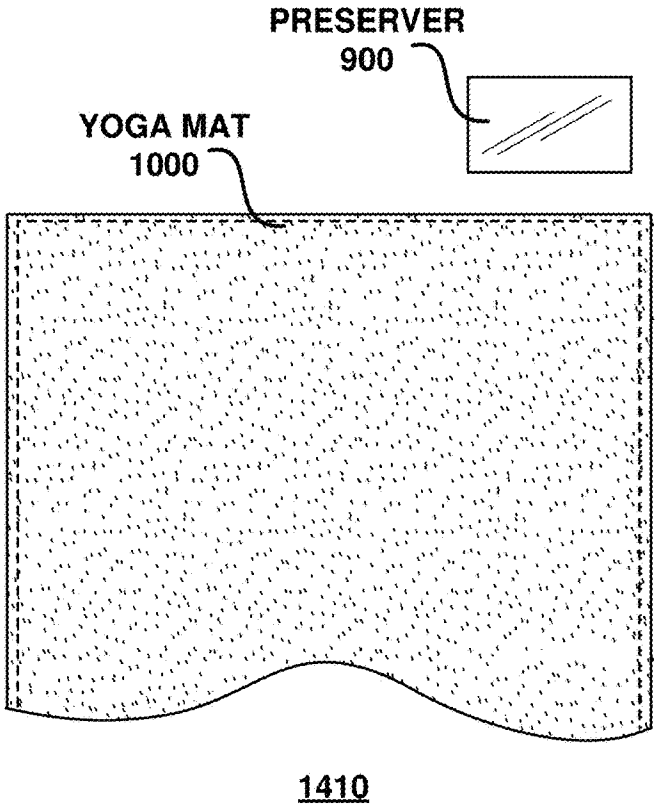
FIG. 12 illustrates exemplary placements of a yoga mat preserver relative to a yoga mat during a yoga session in accordance with an aspect of the subject specification.
Figure 12:
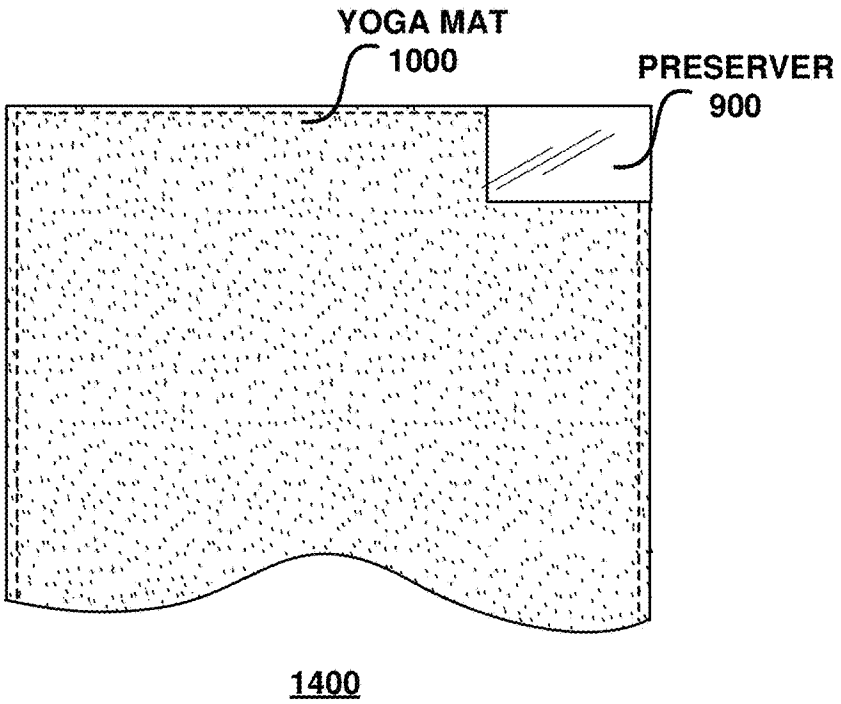

In another aspect of the disclosure, various placements of a yoga mat preserver relative to a yoga mat during a yoga session are also contemplated, as illustrated in FIG. 12. In view 1400, for instance, yoga mat preserver 900 is folded and placed on a corner of yoga mat 1000. Within such embodiment, it should be appreciated that yoga mat preserver 900 may also be folded in such a manner that allows attachment mechanism 910, for example, to remain firmly attached to a corner of yoga mat 1000. Alternatively, as illustrated in view 1410, yoga mat preserver 900 may be folded and placed away from yoga mat 1000.

Figure 13:
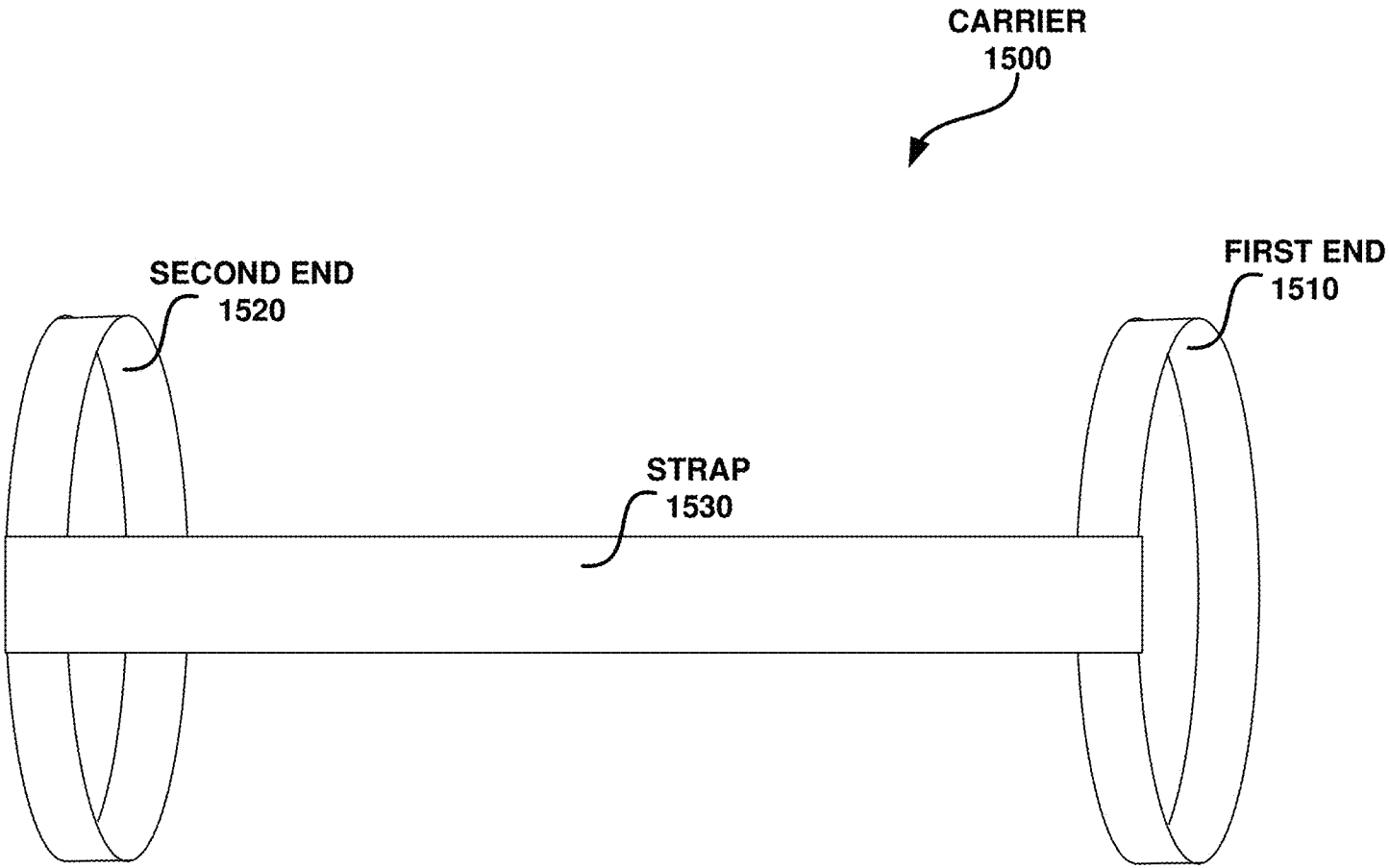
FIG. 13 illustrates an exemplary yoga mat carrier in accordance with an aspect of the subject specification.

In yet another aspect of the disclosure, a yoga mat carrier is contemplated, such as the yoga mat carrier 1500 shown in FIG. 13. As illustrated, yoga mat carrier 1500 may include a first end 1510 configured to wrap around a circumference of a first end of a rolled yoga mat, and a second end 1520 configured to wrap around a circumference of a second end of the rolled yoga mat. The yoga mat carrier 1500 may further include a strap 1530 in which a first end of the strap 1530 is attached to the first end 1510 of the yoga mat carrier 1500, and a second end of the strap is attached to the second end 1520 of the yoga mat carrier 1500.

It should be appreciated that various designs are contemplated for the first end 1510 and second end 1520 of the yoga mat carrier 1500. For instance, in a first embodiment, at least one of the first end 1510 or second end 1520 of the yoga mat carrier 1500 is an elastic band. In another embodiment, however, at least one of the first end 1510 or second end 1520 of the yoga mat carrier 1500 is a tightening strap (e.g., where opposite ends of the first end 1510 or second end 1520 attach with Velcro).

Figure 14:
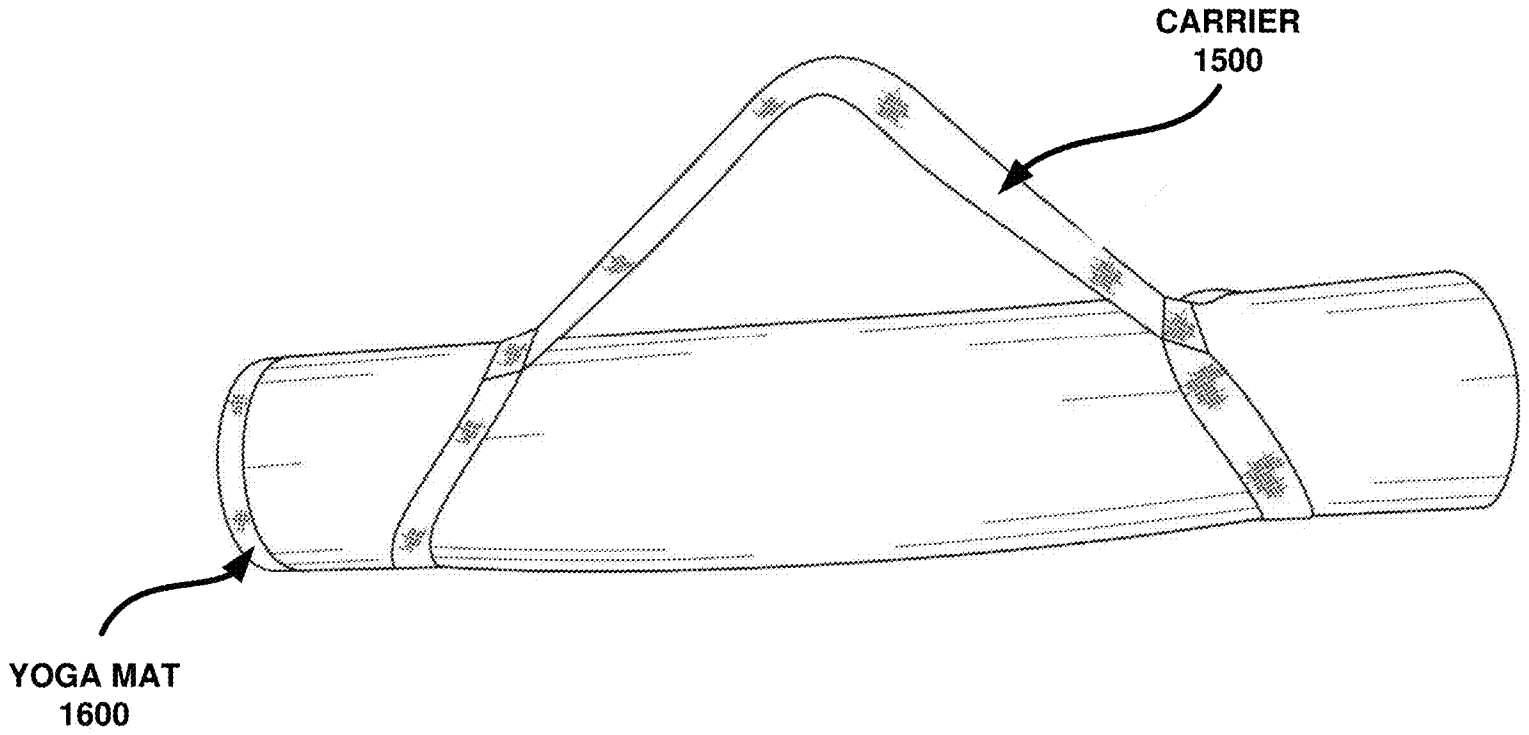
FIG. 14 illustrates an exemplary yoga mat carrier coupled to a yoga mat in accordance with an aspect of the subject specification.

Referring next to FIG. 14, yoga mat carrier 1500 is shown coupled to a yoga mat 1600 in accordance with an aspect of the subject specification. As illustrated, it is contemplated that strap 1530 can be held by hand and/or like a backpack strap around one's shoulder. With respect to material, it is contemplated that strap 1530 should utilize durable material, wherein such material is not limited to a specific type of webbing and or specific fibers, width, length, or density.

Figure 15:
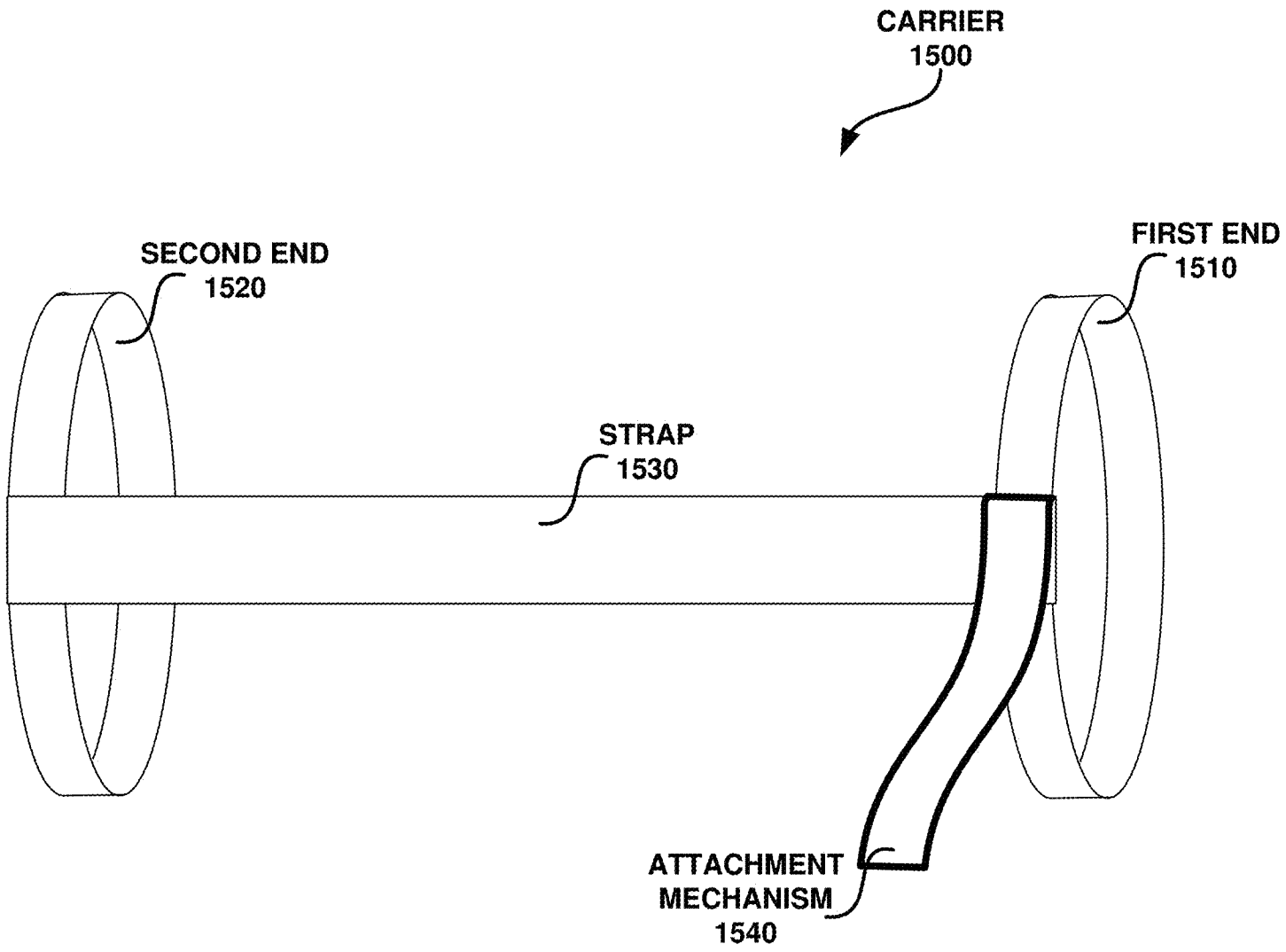
FIG. 15 illustrates an exemplary yoga mat carrier with an attachment mechanism in accordance with an aspect of the subject specification.
Figure 16:
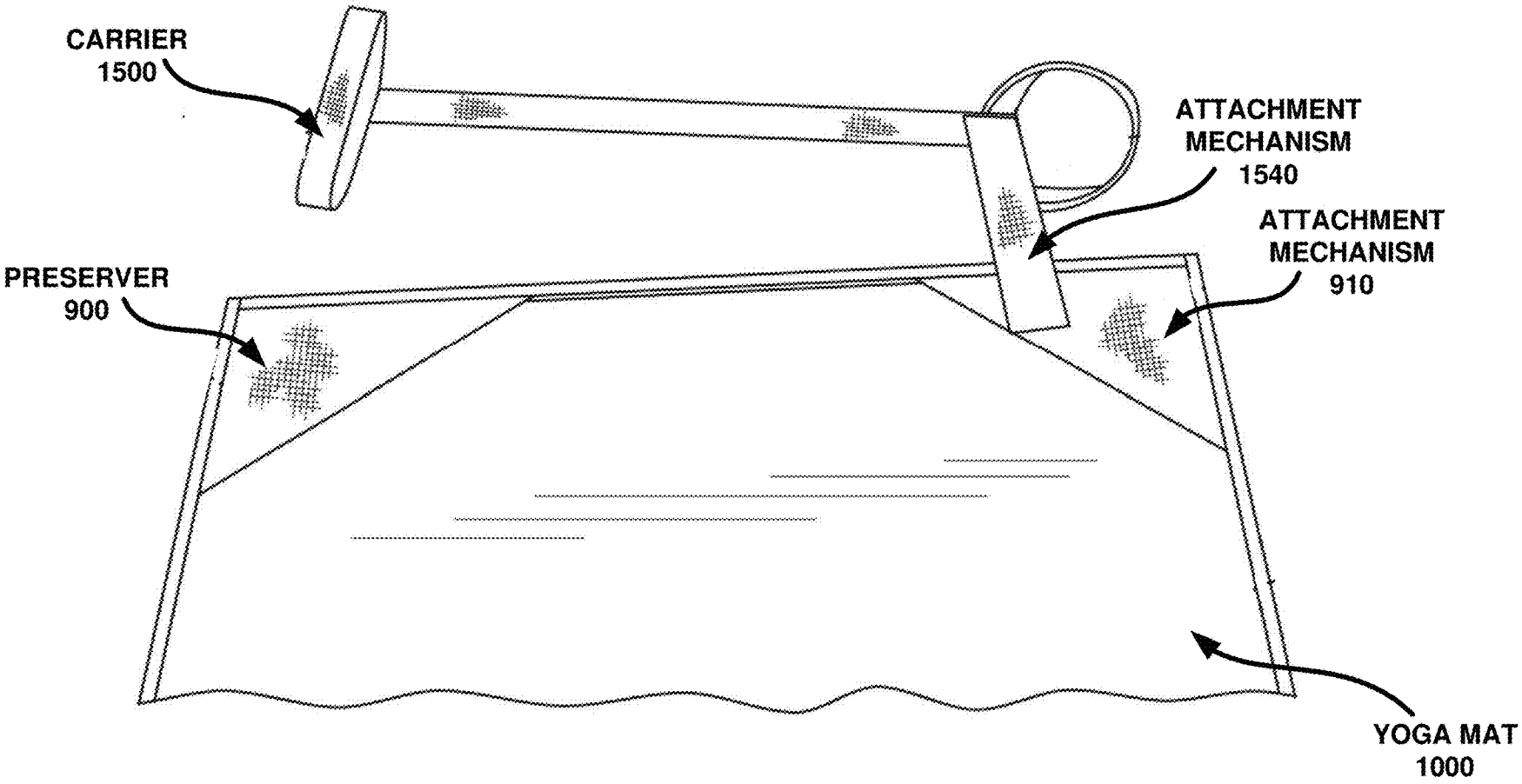
FIG. 16 illustrates an exemplary yoga mat carrier with an attachment mechanism coupled to a yoga mat preserver in accordance with an aspect of the subject specification.

Referring next to FIG. 15, yoga mat carrier 1500 is shown with an attachment mechanism 1540 in accordance with an aspect of the subject specification. Namely, as illustrated in FIG. 16, it is contemplated that attachment mechanism 1540 may facilitate attaching yoga mat carrier 1500 to a yoga mat preserver. For instance, FIG. 16 provides an example in which attachment mechanism 1540 facilitates attaching yoga mat carrier 1500 to the yoga mat preserver 900 illustrated in FIG. 9. For this particular example, it is contemplated that attachment mechanism 1540 is configured to attach to attachment mechanism 910 (e.g., via Velcro, sewn, etc.), as shown.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components coupled to other components rather than included within parent components (hierarchical). Additionally, it is noted that one or more components may be combined into a single component providing aggregate functionality or divided into several separate sub-components, and any one or more middle layers may be provided to couple to such sub-components in order to provide integrated functionality. Any components described herein may also interact with one or more other components not specifically described herein but generally known by those of skill in the art.

In view of the exemplary systems described supra, methodologies that may be implemented in accordance with the disclosed subject matter can be appreciated with reference to the various figures. While for purposes of simplicity of explanation, the methodologies are described as a series of steps, it is to be understood and appreciated that the disclosed subject matter is not limited by the order of the steps, as some steps may occur in different orders and/or concurrently with other steps from what is described herein. Moreover, not all disclosed steps may be required to implement the methodologies described hereinafter.

While the various embodiments have been described in connection with the exemplary embodiments of the various figures, it is to be understood that other similar embodiments may be used or modifications and additions may be made to the described embodiment for performing the same function without deviating there from. Therefore, the present invention should not be limited to any single embodiment.

What is claimed is:

1. A yoga mat preserver, comprising:

a perimeter with dimensions substantially similar to a yoga mat;

a multilayered body having a combined thickness of less than ¼8th of an inch and spanning an entire area within the perimeter, and wherein the multilayered body includes material that facilitates a clinging of the yoga mat preserver onto the yoga mat via static electricity; and an attachment mechanism configured to facilitate attaching the yoga mat preserver to the yoga mat, wherein the attachment mechanism is a triangular pocket on a corner of the yoga mat preserver, and wherein the triangular pocket is configured to receive a corresponding corner of the yoga mat.

2. The yoga mat preserver according to claim 1, wherein the multilayered body comprises a first monolithic layer and a second monolithic layer, and wherein a material of the first monolithic layer is different than a material of the second monolithic layer.

3. The yoga mat preserver according to claim 2, wherein the material of the first monolithic layer is a moisture absorbent material.

4. The yoga mat preserver according to claim 2, wherein the material of the first monolithic layer is a moisture resistant material.

5. The yoga mat preserver according to claim 1, wherein the yoga mat preserver is foldable.

6. The yoga mat preserver according to claim 1, wherein the yoga mat preserver is machine washable.

7. A yoga mat preserver, comprising:

a perimeter with dimensions substantially similar to a yoga mat;

a multilayered body spanning an entire area within the perimeter, wherein the multilayered body includes material that facilitates a clinging of the yoga mat preserver onto the yoga mat via static electricity; and an attachment mechanism configured to facilitate attaching the yoga mat preserver to the yoga mat, wherein the attachment mechanism is a pocket on an end of the yoga mat preserver, and wherein the pocket is configured to receive a corresponding end of the yoga mat.

* * * * *